United States Patent [19]

Sanders

[11] Patent Number: 4,650,089

[45] Date of Patent: Mar. 17, 1987

[54] REFUSE CONTAINER COVER MOUNT AND METHOD OF RETROFITTING REFUSE CONTAINER

[76] Inventor: Glen Sanders, 1372 Sierra Alta Dr., Tustin, Calif. 92680

[21] Appl. No.: 819,718

[22] Filed: Jan. 17, 1986

[51] Int. Cl.[4] ..... B65D 43/14; B65D 57/04

[52] U.S. Cl. ..... 220/334; 220/1 T

[58] Field of Search ..... 220/1 T, 334

[56] References Cited

U.S. PATENT DOCUMENTS

| | | | |
|---|---|---|---|
| 4,158,424 | 6/1979 | Carmack | 220/334 |
| 4,335,828 | 6/1982 | Robinson et al. | 220/334 |
| 4,342,402 | 8/1982 | Jungles | 220/1 T |

*Primary Examiner*—George T. Hall

*Attorney, Agent, or Firm*—Stetina and Brunda

[57] ABSTRACT

An improved refuse container cover mount and method of retrofitting refuse containers is disclosed characterized by use of an improved mounting bracket adapted to be positioned upon the refuse container including a pair of offset apertures positioned to accommodate the mounting of differing sized container covers.

15 Claims, 4 Drawing Figures

REFUSE CONTAINER COVER MOUNT AND METHOD OF RETROFITTING REFUSE CONTAINER

BACKGROUND OF INVENTION

This invention relates generally to refuse containers and more particularly to an improved refuse container cover mount and method of retrofitting refuse containers.

As is well known, conventional commercial or industrial refuse containers generally comprise relatively large open-topped bins formed of sheet metal which are adapted to cooperate with fork lift mechanisms to facilitate rapid refuse collection. Typically, a rectangular lid or cover is pivotally connected to the top of said refuse container by plural "ear brackets" which extend upwardly and rearwardly from the back of said refuse container. A plurality of barrel hinges are disposed along the rear edge of the rectangular cover and a connecting rod is inserted through the barrel hinges and ear brackets to pivotally connect the cover to the refuse container. A cotter pin or similar retention means is typically utilized to prevent the disengagement of the connecting rod from the ear brackets and cover.

The earliest prior art commercial refuse container tops were formed of sheet metal or wood, wherein the barrel hinges were disposed along the rear edge of the cover. These metal covers may still be used in applications requiring extra cover penetration protection, such as on construction sites. However, with the present advances of plastic technology, new roto molded or vacuum formed plastic covers have been introduced in the market place. The advantages of using plastic covers include: (1) the ability to ensure a snug fit and thus seal refuse and its odor inside the refuse container, (2) increased safety resulting from their lighter weight, and (3) quieter use since the cover is lighter and able to be more easily opened and closed. These plastic refuse container covers are typically constructed to having a double-walled framework with structural ribs, and thus have a much greater vertical thickness than the conventional sheet metal covers. As a result of this extra thickness, the pivot axis of the plastic lid cover barrel hinges in relation to that of the mounting ear brackets or lugs is displaced upwardly and rearwardly to that of sheet metal cover barrel hinges. Because of this displacement in the positioning of the barrel hinge axis, a plastic cover, when substituted for a sheet metal cover, cannot seat properly and therefore cannot close. As a result, if conversion is desired between metal and plastic covers, the prior art has generally required that the cover mounting ear brackets be manually ground off and removed and new ear brackets or cover mounts welded or otherwise fixedly attached to the container. As a result, there is a need for an improved refuse container cover mount which can be used with both plastic and metal lids so that the cover mount or ear brackets, once mounted upon the refuse container can accommodate either the metal or plastic covers without requiring further removal and retachment of appropriately dimensioned mounting brackets.

SUMMARY OF INVENTION

The present invention specifically overcomes these deficiencies in the prior art by providing an improved refuse cover mount bracket having a pair of pivot axis, one of which is off-set and vertically raised from the other to allow the bracket to accept both plastic and or metal refuse container covers. This improved cover mount bracket can be incorporated into the original manufacturing process of the commercial refuse containers or alternatively be sold separately for retrofitting existing commercial containers.

The improved cover mounting bracket preferably comprise a generally triangular shaped piece of sheet metal sized to extend upwardly and rearwardly from the back edge of the refuse container. A first edge provides a surface to rigidly attach the bracket to the refuse container by conventional welding methods. In addition, the bracket is formed to have a universal mounting means disposed in its upper portion.

This universal mounting means comprises the forming of the bracket to have at least a pair of apertures disposed in its distal portion, one aperture being disposed upwardly and rearward of the other. By providing a pair of offset apertures, the present invention provides a means to accommodate the use of both the plastic and/or metal prior commercial refuse container covers in conjunction with the same mounting bracket.

Thus, in use, the refuse container cover is removed by disengaging the connecting rod from pivotal engagement with the barrel hinges and the conventional cover mount. After removing the conventional cover mount and rigidly attaching the improved cover mount of the present invention, either a plastic or metal refuse container lid may be pivotally reattached to the refuse container. As such, the present invention provides a means to interchange refuse container covers at will, without incurring time and expense for reattaching a different cover mount each time and facilitates rapid cover installation directly in the field.

BRIEF DESCRIPTION OF THE DRAWINGS

These as well as other features of the present invention will become more apparent upon reference to the drawings herein.

DETAILED DESCRIPTION OF THE PREFERRED EMBODIMENT

Figure 1:
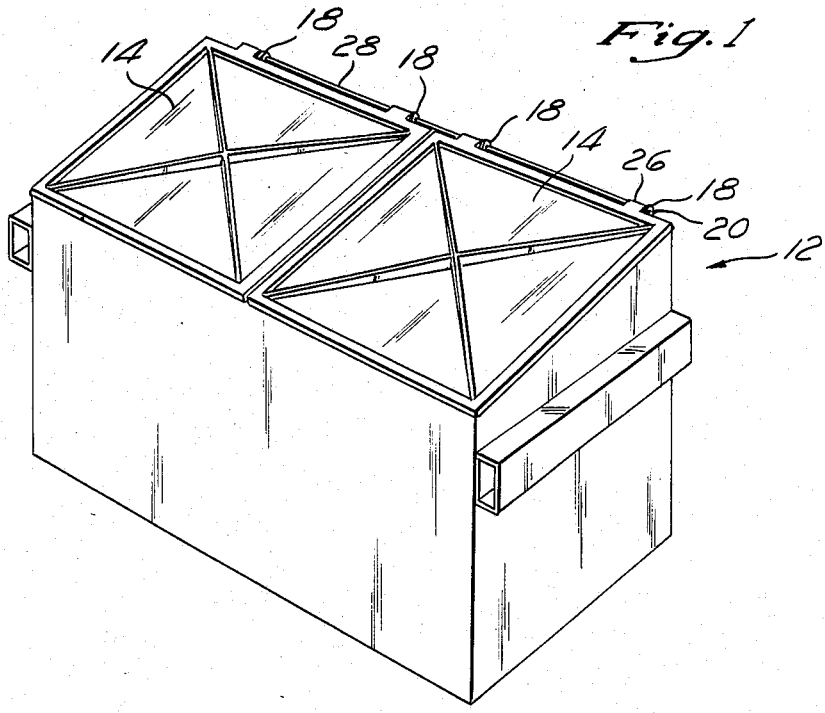
FIG. 1 is a perspective view of a conventional refuse container.
Figure 2:
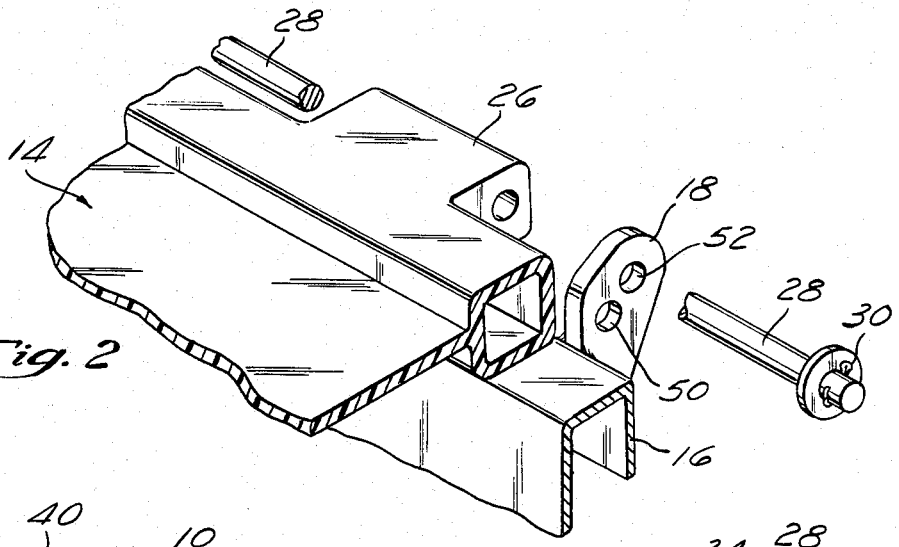
FIG. 2 is an exploded perspective of the present invention.

As a general overview, a conventional commercial refuse container 12 typically includes a cover or top 14 pivotally mounted along the top of the container's back wall 16. This pivotal connection typically comprises the use of plural cover mounts or ear brackets 18, each having an aperture 20 formed therein which are rigidly mounted to the back wall 16 of the refuse container 12 as by way of conventional welding methods or the like. Disposed along an edge 22 of the refuse container lid 14, either rigidly mounted or integrally formed therein, are a plurality of barrel hinges 26. With the lid 14 disposed so that the barrel hinges 26 have their axis aligned with the central axis of the apertures 20 of the ear brackets 18, a connecting rod 28 is inserted through the ear bracket apertures 20 whereby the cover 14 is pivotally connected to the refuse container body 12. A retention means or cotter pin 30 is inserted radially through the connecting rod 28 to prevent the removal of the connecting rod 30 and thus the disengagement of the cover 14 from the refuse container 12. Alternatively the retention means may be an end cap or knob rigidly attached to the end of the connecting rod 28 by conventional welding means.

Figure 3:
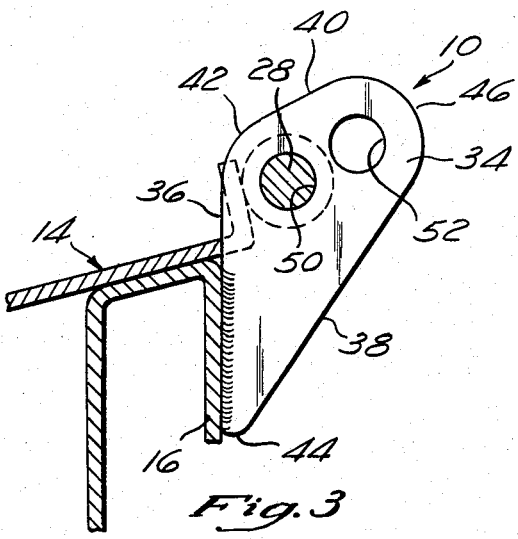
FIG. 3 is a side view depicting the present invention in use with a metal cover for the refuse container.
Figure 4:
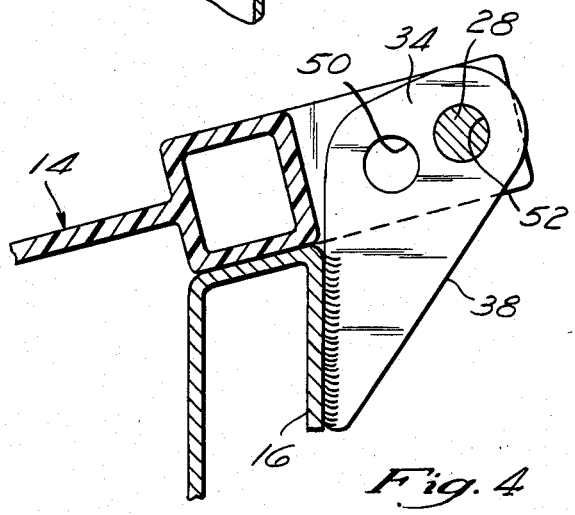
FIG. 4 is a side view depicting the present invention in use with a plastic cover for the refuse container.

As more particularly shown in FIGS. 3 and 4, the barrel hinge axis of metal and plastic refuse container covers are dissimilarily located relative to the edge of refuse container lid 22. As depicted in FIG. 3, the barrel hinge axis of the metal refuse container cover is located forward and downward relative to the axis of the plastic lid as depicted in FIG. 4. As a result, when one cover type has been substituted for the other in the prior art, the differences in the relative positioning of the barrel hinge axis has precluded a proper orientation and thus closure of the cover without replacement of the mounting bracket.

Referring to FIGS. 1–4, there is shown the improved refuse container cover mount of the present invention, designated generally by the numeral 10. The improved refuse container cover mount comprises of an improved ear bracket 34; having means for permitting the universal mounting of both prior art metal and plastic covers onto the refuse container.

Referring to FIGS. 3 and 4, a more detailed description of the improved ear bracket 34 may be presented. The ear bracket 34 preferably comprises a triangular shaped plate preferably formed of one-eighth ($\frac{1}{8}$) inch thick sheet metal. The improved bracket 34 is defined by three edges, a first or front edge 36, a second or back edge 38 and a third or top edge 40.

In the preferred embodiment, the first or front edge 36 of the bracket is approximately three inches in length and provides a surface to be rigidly attached by conventional welding means to the refuse container 12, generally the back wall 16 of the refuse container 12.

At the top end of the front edge 36, the first or front edge 36 and third or top edge 40 of the bracket meet at an obtuse interior angle to form a rounded first corner transition 42, having a radius of three-eights ($\frac{3}{8}$) of an inch. At the bottom of the front edge 36, the front edge 36 and the second or back edge 38 meet at an acute interior angle to form a second rounded corner transition 44 of approximately one-eight ($\frac{1}{8}$) inch radius.

In the preferred embodiment, both the back edge 38 and the top edge 40 extend upwardly and rearwardly from the front edge 36 to form a third rounded corner transition 46 having a radius of three eighths ($\frac{3}{8}$) of an inch. The top edge 40 is formed to extend upwardly at a lesser angle than that of the back edge 34 so that the flange 32 extends generally in an upward and rearward orientation relative the front edge 36. This relationship is dictated by the orientation of the barrel hinges 26 to the top of the refuse container 14. Conventionally, the barrel hinges 26 extends rearwardly in parallel plane to the container 14. While other configurations are contemplated herein, any shape can be used so long as the apertures 20 of the bracket 34 are positioned to concentrically align with the axis of the barrel hinges 26 to allow the pivotal connection of the refuse container 12 with its cover 14.

A pair of apertures or holes 50 and 52, are formed in the bracket 34 with the second aperture 52 being disposed upwardly and rearwardly of the first aperture 50. These apertures 50 and 52 are sized to receive the connecting rod 28 therethrough to pivotally connect the refuse cover 14 via the cover mounts or ear brackets 18 and barrel hinges 26 as earlier described. More particularly, the aperture 50 is disposed to align with the axis of the barrel hinges of metal covers, while the aperture 52 is disposed to align with the axis of the barrel hinges of plastic covers. In the preferred embodiment, the apertures 50 and 52 are sized to receive conventionally sized connecting rods and are thus nine sixteenths (9/16th) inches in diameter. However, it is contemplated that differing sized apertures may be used to receive differing sized connecting rods if so desired.

In the preferred embodiment, the apertures 50 and 52 are symetrically positioned inwardly from the first corner 42 and the third corner 46 transition respectively. The second aperture 52 has its axis disposed a distance of approximately three quarters ($\frac{3}{4}$) of an inch rearward of the first aperture 50 along a line that is parallel to the top edge 18. By this disposal, the cover mount 18 can alternatively mount plastic or metal covers having different barrel hinge axis to the refuse container. Thus, once the improved mounting brackets 34 of the present invention are attached to the commercial refuse container, either during the initial manufacturing process or by retrofitting to already manufactured commercial refuse containers, one need not replace the brackets when it is desired to interchange metal to plastic refuse container covers. Thus no additional structural modifications resulting in loss of time and increased costs need be incurred.

In retrofitting already existing commercial trash containers, the following procedure is used. Generally speaking, the cotter pin or other retention means 30 is removed so that the connecting rod 28 may slide out of pivotal engagement with the barrel hinges 26 of the refuse container top 14. The refuse container cover 14 is then removed and the existing prior art ear brackets are removed from engagement with the refuse container by conventional grinding means. The improved ear brackets of the present invention may then be rigidly attached at approximately the same location as the prior mounting brackets. The connecting rod 28 may be inserted through the respective concentrically aligned apertures 50 or 52 in the improved ear brackets 10 and the barrel hinges 26 of the refuse container top, be it a plastic or metal cover. By this procedure, any subsequent interchanging between plastic and or metal lids can be performed at will by merely removing the connecting rod 28, replacing the top 14 and reinserting the rod 28 into pivotal connection.

As such, it will be recognized that the present invention comprises a significant improvement over the prior art devices by providing a means for universally or alternatively mounting the different types of refuse container covers having differently oriented or positioned barrel hinges. As such, the present invention provides a quick and easy way for subsequent installation and use of different types of commercial refuse bin container lids.

Having described a preferred embodiment of the present invention, various modifications will now become apparent from this specification and the drawings which clearly are contemplated within the scope of the appended claims.

What is claimed is:

1. A refuse container cover mount comprising:

a bracket, said bracket formed to extend upwardly and rearwardly from a refuse container; and a universal mounting means, disposed in said bracket for accommodating differing covers for said refuse container having differing pivot axis.

2. The device of claim 1 wherein said bracket is formed as a triangular shaped plate.

3. The device of claim 1 wherein said bracket comprises a triangular plate element having three edges, a first edge to be rigidly connected to the refuse container, a second edge depending upwardly and rearwardly from one end of the first edge and a third edge depending upwardly and rearwardly at a less acute angle than the second edge whereby the plate element is formed to extend upwardly and rearwardly from the first edge.

4. The device of claim 1 wherein the universal mounting means comprises forming at least a pair of apertures vertically offset with respect to one another.

5. The device of claim 4, wherein said apertures are formed so that the second aperture is positioned upwardly and rearwardly of the first aperture.

6. The device of claim 5 wherein the axis of said pair of apertures are located on a parallel plane to the plane of said second edge.

7. An improved refuse container cover mount for a refuse container having a top member, barrel hinges, cover mounts, and a connecting rod therethrough to pivotally connect the refuse container cover and the refuse container, wherein the improved refuse container cover mount comprises:

a flange, said flange formed to extend upwardly and rearwardly from a refuse container; and a universal mounting means, said mounting means disposed in the distal portion of the flange.

8. The device of claim 7 wherein the flange further comprises a triangular plate of sheet metal.

9. The device of claim 8 wherein the flange further comprises of a triangular plate element defined by three edges, a first edge to be rigidly connected to the refuse container, a second edge depending upwardly and rearwardly from the first edge; and a third edge depending upwardly and rearwardly at a more acute angle than the second edge whereby the plate element extends upwardly and rearwardly from the first edge.

10. The device of claim 7 wherein the universal mounting means further comprises forming the flange to have a pair of apertures so that the second aperture is formed upwardly and rearwardly of the first aperture.

11. The device of claim 10 wherein the universal mounting means further comprises forming the apertures in parallel to the second edge equidistant from the first, second and third edges, the second aperture disposed upward one quarter of an inch and rearward three quarters of an inch from the first aperture at an angle of approximately 20 degrees.

12. A method for retrofitting a refuse container comprising the steps:

removing the connecting rod retaining the refuse container top and body in pivotal engagement;

removing the rigidly mounted ear brackets;

attaching the improved cover mounts;

inserting the connecting rod into pivotal engagement with the refuse container top and the refuse container body.

13. The method of claim 12 wherein the cover mount removing step further comprises the step:

grinding off the rigidly mounted cover mounts.

14. The method of claim 13 wherein the attaching step further comprises the steps:

sanding the surface where the rigidly attached cover mounts were previously rigidly mounted; and preparing the surface for attaching the improved cover mounts.

15. The method of claim 13 wherein the attaching step further comprises the steps:

welding the improved cover mounts to the prepared surface.

* * * * *